US005602958A

United States Patent [19]

Vergnes

[11] Patent Number: 5,602,958

[45] Date of Patent: Feb. 11, 1997

[54] RECHARGEABLE STEAM GENERATOR

[75] Inventor: Jean-Daniel Vergnes, Steinbach, France

[73] Assignee: Superba, Mulhouse, France

[21] Appl. No.: 337,998

[22] Filed: Nov. 10, 1994

[30] Foreign Application Priority Data

Nov. 19, 1993 [FR] France ..... 93 13840

[51] Int. Cl.[6] ..... F24F 6/00

[52] U.S. Cl. ..... 392/395; 392/390

[58] Field of Search ..... 392/386, 390, 392/394, 395, 398, 400, 401, 406, 392, 405; 239/44, 45, 47, 51.5

[56] References Cited

U.S. PATENT DOCUMENTS

| | | | |
|---|---|---|---|
| 4,748,314 | 5/1988 | Desage | 219/274 |
| 4,924,068 | 5/1990 | Henri | 219/274 |
| 5,014,337 | 5/1991 | Desage | 392/395 |

FOREIGN PATENT DOCUMENTS

| | | | |
|---|---|---|---|
| 0240387 | 7/1987 | European Pat. Off. | B01D 1/00 |
| 0317444 | 5/1989 | European Pat. Off. | F22B 1/28 |
| 0323328 | 5/1989 | European Pat. Off. | F22B 1/30 |

*Primary Examiner*—Teresa J. Walberg
*Assistant Examiner*—Sam Paik
*Attorney, Agent, or Firm*—Rosen, Dainow & Jacobs, L.L.P.

[57] ABSTRACT

A steam generator includes an orifice for feeding water to a porous material, a heater element passing through said porous material, and an outlet orifice for the steam created by heating said water, wherein the porous material and its heater element are contained in a case disposed in a removable sealed cassette that is connected in operation to a fixed portion of the generator containing water feed means, means for controlling the heater elements, and means for taking off the steam. The sealed cassette is connected to the fixed portion of the generator by means of snap-fastenings in order to enable rapid connection and deconnection, and it includes a water admission orifice connected to an internal case containing a heater element for the water and around which a porous material is compressed, said case including orifices over its entire surface for evacuating the steam produced by the heater element, with the steam being extracted from the cassette via a steam outlet orifice.

19 Claims, 6 Drawing Sheets

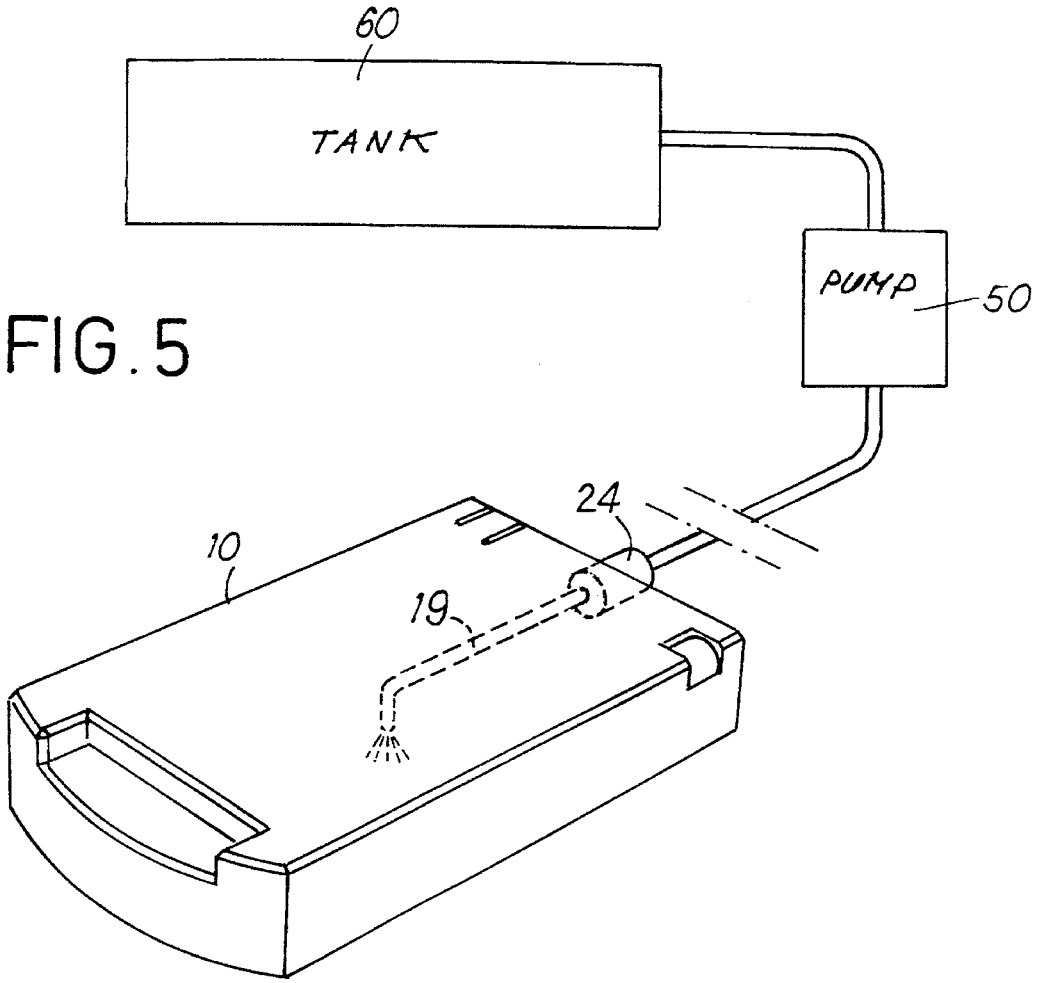
FIG. 5
FIG. 6
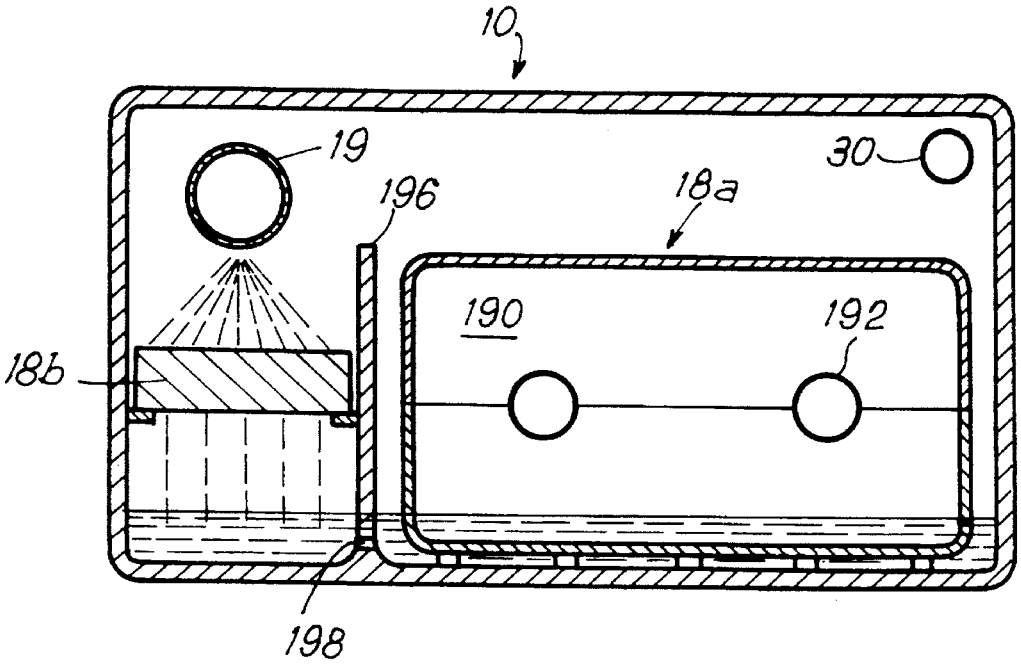

RECHARGEABLE STEAM GENERATOR

A RECHARGEABLE STEAM GENERATOR

The present invention relates to a steam generator whose active portion can be connected and disconnected directly by the user for replacement purposes.

BACKGROUND OF THE INVENTION

A steam generator is conventionally constituted by a water tank including a filler duct and communicating with a distribution chamber via a water injection device, said chamber including an outlet orifice through which the steam created by heating the water in the tank escapes.

It is known that the lifetime of such steam appliances is limited by the formation of scale that results from the water in the tank evaporating, the scale accumulating at the inlet and outlet orifices of the steam-generating chamber. The greater the lime content of the water used, the shorter the lifetime of the appliance.

Present solutions to this problem posed by scale forming in steam generators are numerous, but none of them is satisfactory: pretreatment of the water or the use of demineralized water is expensive and with demineralized water it can sometimes require the use of special materials; regular washing out of the appliance constitutes a constraint that is poorly adapted to professional utilization; scale destruction by creating passages between the tank and the evaporation zone requires the use of mechanical devices that are complex, such as anti-scale rods; similarly, detecting scale accumulation by measuring the pressure of the fluid circulating through the generator requires sensors to be used, which sensors must be monitored continuously.

OBJECTS AND SUMMARY OF THE INVENTION

An object of the present invention is to mitigate the above drawbacks, i.e. to propose a generator that does not require any :special maintenance or monitoring, and that does not require any specific treatment of the water. Another object of the invention is to provide a steam generator that is simple to implement, reliable, and cheap.

These objects are achieved by a steam generator including an orifice for feeding water to a porous material, a heater element passing through said porous material, and an outlet orifice for the steam created by heating said water, the porous material and its heater element being contained in a case disposed in a removable sealed cassette that is connected in operation to a fixed portion of the generator containing water feed means, means for controlling the heater elements, and means for taking off the steam. The sealed cassette is connected to the fixed portion of the generator by means of clamps suitable for enabling rapid connection and disconnection.

By having the steam generating components inside a cassette and kept separate from the other components of the generator, it is possible to provide an appliance that is particularly cheap insofar as the cost of the cassette is low (it contains few components), and it is very reliable (the components concerned are simple).

In a first embodiment, the water feed means include an external tank and a pump placed between the tank and the water feed orifice, and enabling water to be selectively injected into the generator. Preferably, the water pumped from the tank is injected into the top portion of the cassette by means of a spray strip.

The use of this pump/tank assembly makes it possible to feed the generator continuously, it being possible to fill the tank at any time without any limitation of capacity. In addition, since the water is injected by the pump at a pressure greater than the internal pressure of the generator, it is easy to direct it to a location in which its transformation into steam is more effective or in which descaling can be performed simply.

In a second embodiment, the water feed means include manual filling means having a siphon for limiting the depth to which water can be filled in the cassette, the manual filling means further include means for interrupting heating and water feed, which means are controlled by rotation of a filler stopper placed at the inlet of said filler means.

Such automatic interruption ensures maximum safety during filling and avoids any steam being produced while filling is taking place.

The generator also includes steam regulator means at the outlet from the cassette.

Visible or audible indicators make it possible to monitor at all times water level, planeness, and scaling of the cassette, with scaling being monitored by a device which is connected to the cassette and which serves to measure the conductivity of the water prior to evaporation.

The present invention also provides a removable steam cassette designed to be implemented in the above steam generator. It includes a water admission orifice distributing said water to an internal case containing a heater element for heating said water, a first porous material being compressed around the heater element, said case including orifices over its entire surface for evacuating the steam produced by the heater elements, the steam being expelled from the cassette via a steam outlet orifice. In order to avoid any return of steam via the water admission orifice, the cassette is provided with means for closing the water admission orifice, which means are activated when the internal pressure of the cassette is less than a determined pressure.

In a particular variant embodiment of the cassette, it further includes a second porous material that is separated from the first porous material surrounding the heater element by a wall extending between two opposite sides of the cassette and leaving an empty space for the passage of steam, the second porous material which constitutes a trap for scale being soaked by means of a spray strip directly with the water pumped from the tank. The wall includes orifices providing communication between the evaporation zone that contains the first porous material and the water feed zone that contains the second porous material, thereby enabling the first porous material to be irrigated with partially descaled water that has passed through the second porous material.

In a second variant embodiment of the cassette, the first porous material and the heater element are integrated in a ring that is advantageously made of plastics material, that is concentric with the outer case of the cassette and that has a free cylinder in its center into which a steam outlet tube secured to said circular outer case plunges to about half-depth.

With this circular structure, it is possible to obtain a generator which is capable of delivering steam in all directions in three-dimensional space.

Preferably, the case is made up of two separable half-boxes having pierced top and bottom faces in order to make it easy to replace the porous material or the heater elements (e.g.: a heater resistance element, a ceramic resistance, and electrodes).

In a third embodiment of the cassette, the water heater element is constituted by a ceramic resistance inserted in the center of a diffuser element made of a heat-conducting material, the first porous material being engaged under pressure between at least three fins of said diffuser and being held in place by the perforated inner case.

High and low water level detection means for cooperating with means for monitoring said levels and present in the fixed portion of the generator make it possible on a constant basis to monitor proper operation of the heat exchanges that take place within the cassette.

In order to determine the presence of a determined level of water in the case, said detection means further include a set of electrical contacts including both the screening of the heater element and a metal strip pressed against the internal portion of the cassette.

BRIEF DESCRIPTION OF THE DRAWINGS

Other characteristics and advantages of the present invention appear more clearly from the following description given by way of non-limiting indication and made with reference to the accompanying drawings, in which:

FIG. 5 shows a variant way of feeding the generator from a pump and an external water tank;

FIG. 6 is a section view through an embodiment of a cassette;

MORE DETAILED DESCRIPTION

Figure 1:
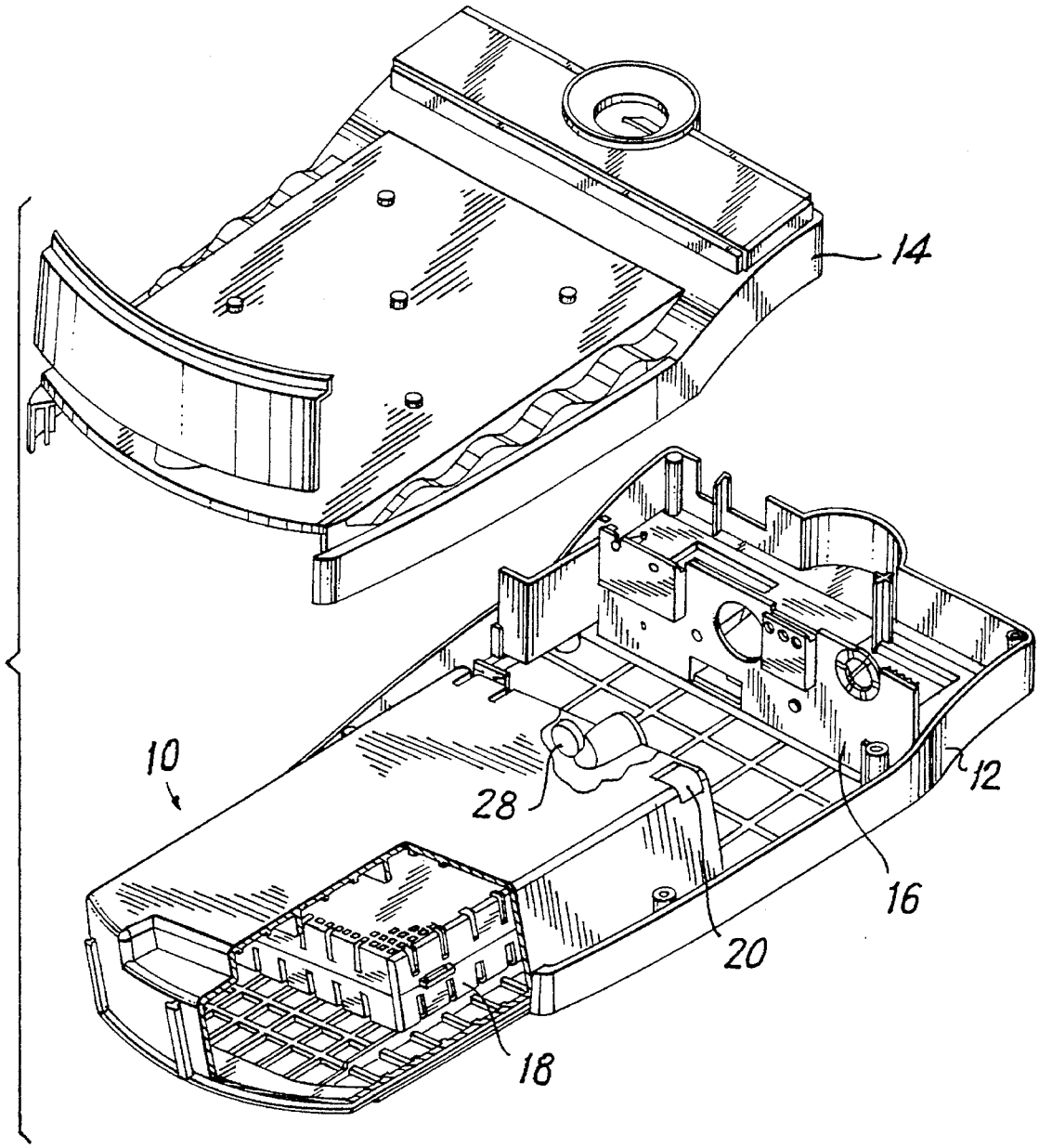
FIG. 1 is a perspective view of a steam generator of the invention.

FIG. 1 is a general view of a steam generator of the invention. The generator comprises a housing assembly provided with a top housing 14 and a bottom housing 12 within which a steam cassette 10 can be placed. This cassette, which is connectable and disconnectable by the user, is connected to the top and bottom housings 14 and 12 by clamps 20 of conventional snap-fastening structure that make rapid extraction possible when loading or unloading a cassette.

The bottom housing 12 includes a connection plate 16 against which the rear face of the cassette 10 comes into contact for the purpose of providing electrical and mechanical connections between the cassette and the body of the generator.

The cassette 10 is in the form of a sealed enclosure that is generally in the shape of a rectangular parallelepiped (although that shape is not limiting, and an embodiment of a cassette that is circular in section is described below), inside the cassette there is a case 18 whose structure is shown in greater detail in FIG. 2. The inside surface of the cassette 10 has ribs on which the case rests, and because of the different sizes of certain ribs, they serve to support the cassette.

Figure 2:
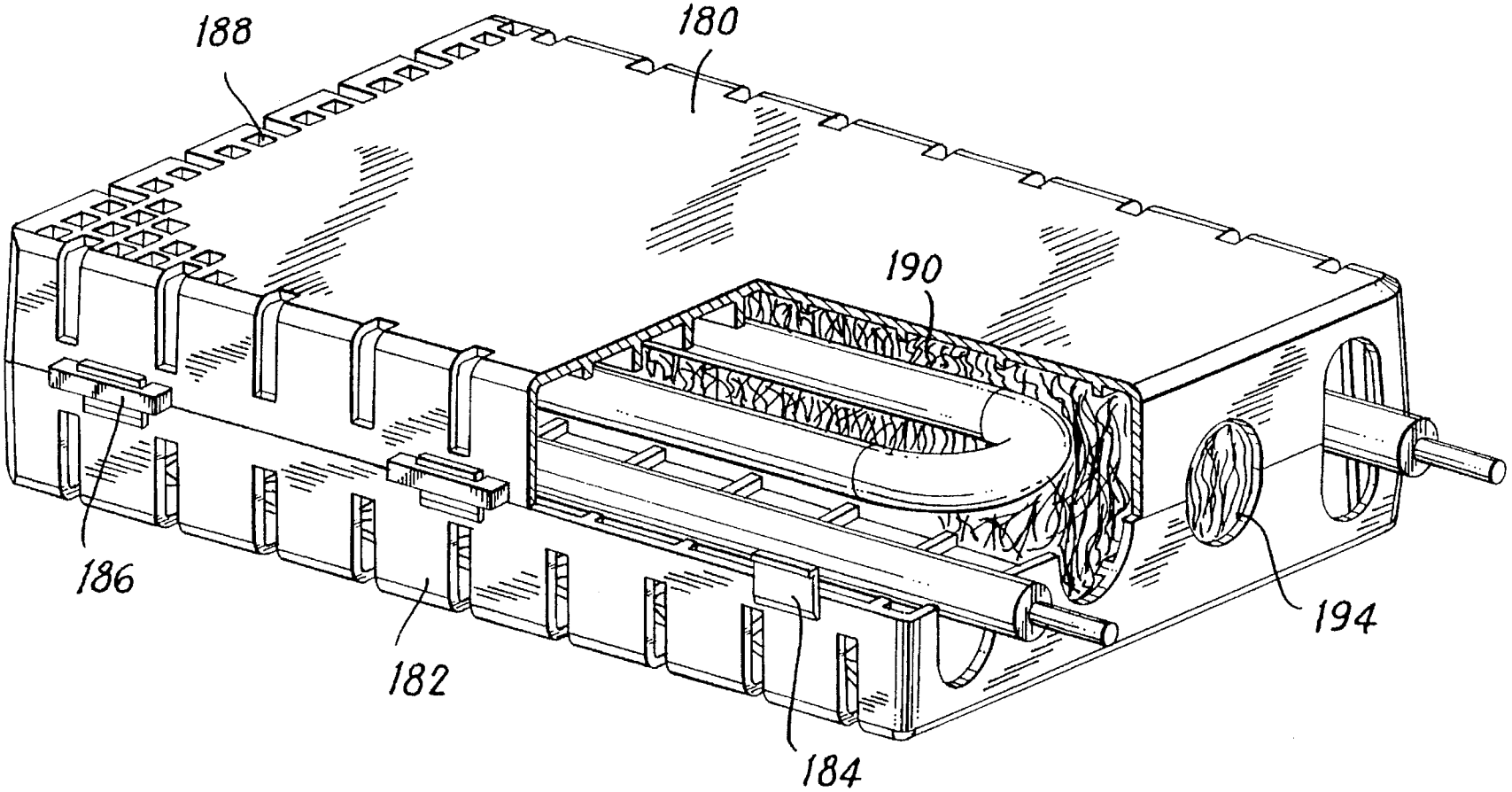
FIG. 2 is a perspective view of a component of the active portion of the steam generator, which active portion is constituted by a removable cassette.

FIG. 2 shows more clearly the structure of the case 18 which is in the form of a rectangular parallelepiped constituted by two half-boxes: namely a top half-box 180 and a bottom half-box 182. They are connected together by fastening means 184, 186 disposed on each of them in order to facilitate disassembly. The top and bottom faces of this parallelepiped are pierced by a multitude of orifices 188.

The case is filled with a porous material 190 surrounding a heater element, e.g. a heating resistance element 192 (however electrodes or a ceramic resistance element could equally well have been used), with the purpose of the case being to hold the porous material geometrically in place relative to the water and to keep it in compression around the heater element. Given the temperatures involved, which are less than 100° C., the case may be made very simply and at low cost out of a plastics material. A water admission orifice 194 is formed at the end of the case, with the steam produced by the heater resistance heating the water escaping via the orifices 188.

Figure 3:
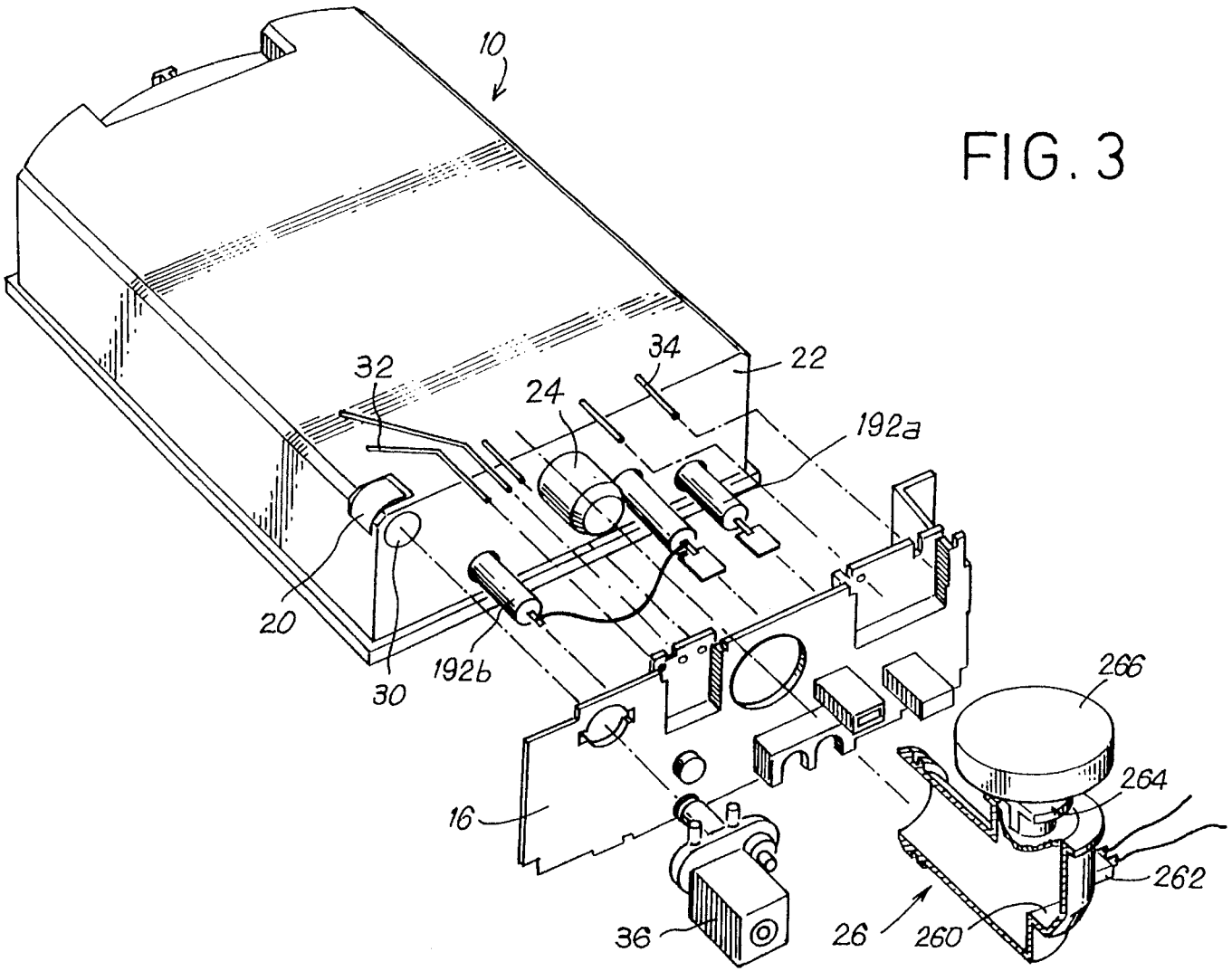
FIG. 3 is a perspective view of the steam cassette and of its device enabling it to be fixed to the generator of the invention.

FIG. 3 is a detail view of the connections made between the cassette 10 and the connection plate 16 of the generator housing. Some of the above-described components can be seen such as the fixing means 20 for fixing the cassette to the top housing 14 of the generator (analogous means being present on the bottom face of the cassette for fixing it to the bottom housing), or the heater resistance of the case which may be constituted by two resistance elements **192*a* and 192*b* in series and emerging from the cassette through its rear face 22 for the purpose of being electrically connected to the connection plate 16. A duct 24 fixed to the admission orifice 194 of the case likewise emerges from said rear face and passes through the connection plate 16 so as to be fixed in sealed manner to a water feed endpiece 26 (sealing being guaranteed by using an O-ring, for example). At the inlet to the duct, inside the cassette, there are shutter means 28 for shutting the water admission orifice 194 (see FIG. 1), which means are activated when the internal pressure inside the cassette is lower than a predetermined threshold, thereby eliminating any risk of steam backing up via the water admission orifice. Finally, a steam outlet orifice 30 is also formed in the rear face of the cassette for delivering the steam that escapes through the orifices 188 of the case 18** contained inside the cassette.

Notches, e.g. 32 and 34, formed in the body of the cassette serve to receive electrical contacts or electrodes enabling various forms of detection to be performed. Thus, high and low water level detection can be implemented to verify whether the cassette is overflowing or is short of water. Means may also be provided for detecting whether the cassette is horizontal. Electrodes for measuring the conductivity of the water prior to evaporation must also be provided in order to enable the porous material to be changed once it has become covered in scale due to the presence of excessive quantities of lime or of non-soluble minerals.

Means 36 are provided for regulating steam at the outlet from the cassette in order to limit the volume of steam created and to obtain continuous emission of steam. These means comprise a solenoid valve and a pressurestat whose set pressure (pressure of the steam produced) is preferably selected to be less than 0.5 bars. Naturally, the diameter of the steam outlet ducts is adapted appropriately to limit head losses.

The endpiece 26 includes a siphon-forming portion 260 for automatically limiting the depth to which the cassette is filled with water. A contactor 262 placed in said endpiece activates water level measuring electrodes while filling is taking place. The filling means 26 also include means for interrupting water feed, e.g. a cam contact 264 controlled by rotation of a water-filling stopper 266 placed at the inlet to said filling means and thus preventing any steam being generated.

Figure 4:
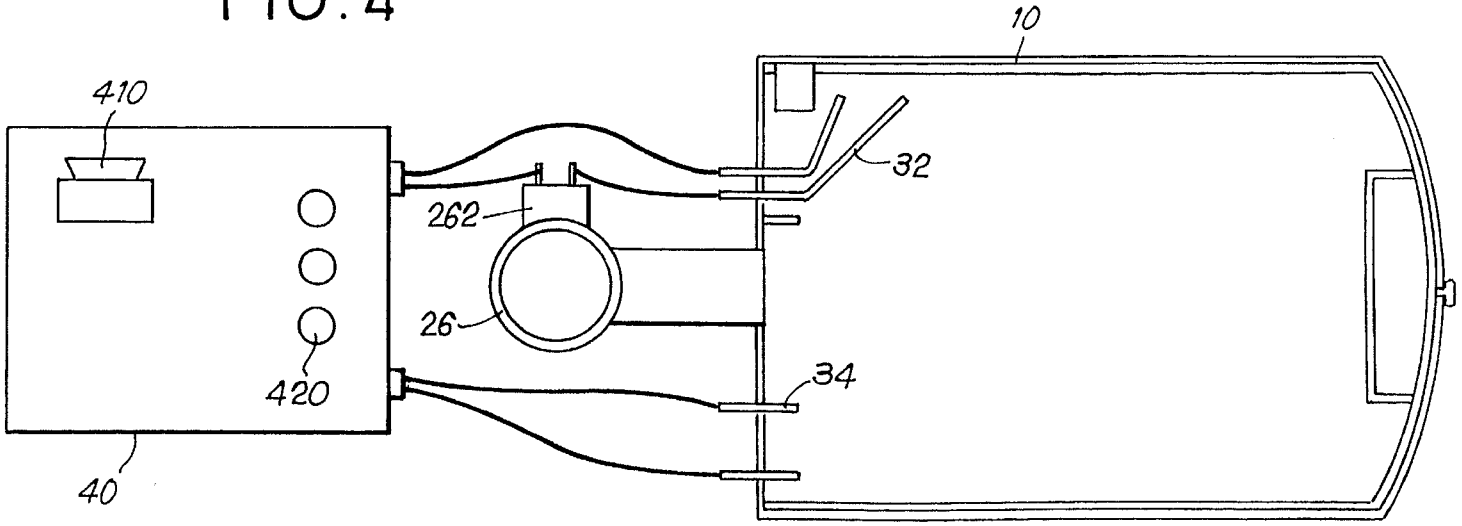
FIG. 4 shows the connections that exist between the steam cassette and the device for monitoring proper operation of the generator of the invention.

The operation of the generator of the invention is particularly simple. Water is injected into the generator via the endpiece 26 (the filling stopper having naturally previously been removed, with removal thereof automatically interrupting heating), and the endpiece fills the case little by little. The various electrodes serve to monitor proper operation of such filling and to inform an electronic control assembly 40 (see FIG. 4) the instant that filling stops. The stopper can then be reclosed, and the generator is ready for use. Activation of the heater resistance causes steam to be produced, which steam escapes via the orifices through the case and emerges from the cassette via the steam outlet orifice so as to be distributed (after regulation) to the zone(s) in which said steam is to be utilized. Visible or audible indicators 420, 410 are provided to respond to water level monitoring by informing the user when it is necessary to refill the cassette with water. Planeness (horizontality) of the cassette is also monitored.

In a variant embodiment enabling the total volume of the cassette to be reduced and as described below with reference to FIGS. 5 to 8, the cassette is fed with water by a pump taking water from a tank external to the generator.

After a certain period of utilization, the cassette becomes clogged with scale and therefore needs to be removed from the generator in order to be changed. Such clogging with scale is indicated by the electronic control assembly which includes the device for measuring water conductivity. The visible or audible indicators 420 and 410 of said assembly serve to inform the user when the cassette has become clogged with scale.

FIG. 5 shows another embodiment of a steam generator of the invention which is fed by a pump-and-tank assembly. The tank 60 contains cold water and may be filled at any time without any limit on capacity. It may be removable or otherwise. A pump 50 is disposed between the tank and the generator which in order to simplify the drawing is represented solely by its cassette 10. The pump acts as a non-return valve preventing any return of hot water back to the tank. The pump enables a minimum amount of water to be injected into the generator for ensuring that it operates properly, it being understood that the smaller the amount of water therein the more quickly steam is produced. Naturally, the generator must include appropriate detector devices, in particular for detecting water level inside the generator, so as to determine when the pump should be put into operation.

As in the preceding embodiment (manual feed through a filler stopper 266), the pump may be controlled to fill the bottom portion of the cassette 10, thereby soaking the bottom portion of the porous material (the capillary body 190) which is heated by the heater resistance element 192, the water being transformed within the capillary body from droplets into steam, which steam escapes via the steam outlet orifice 30. However, in order to enable the water to penetrate more easily into the top portion of the porous material which constitutes a high evaporation zone, it is preferable to bring out the water inlet directly over said porous material, e.g. by means of a spray strip 19 disposed above the case 18 of the cassette 10 and connected to the water inlet duct 24. Unlike the above-described feed to the bottom portion of the cassette which gives rise to bulk scaling of the capillary body pressed around the heater resistance element, this feed from the top gives rise essentially to scaling on the top portion of the hollow body.

FIG. 6 shows an example of a cassette using two porous bodies 18*a* and 18*b*, one of which is soaked directly by the water coming from the spray strip and constitutes a trap for scale. This strip 19 brings the water pumped from the tank into a zone that includes the second porous material 18*b* and that is separated from the evaporation zone which includes the first porous material 18*a* surrounding the heating resistance element 192 by a partition 196 which extends between two opposite sides of said cassette while leaving an empty space to pass the steam that comes from the contiguous evaporation zone. The cold water coming from the tank is sprayed onto the top portion of the second material and at that location, given that heat given off by the steam produced in the evaporation zone, it gives rise to precipitation of salts, and in particular of scale. The water thus partially freed of its scale passes through the porous body 18*b* and collects in the bottom of the cassette from which it irrigates the first porous body 18*a* via connecting orifices 198 formed through the partition 196. The first body 18*a* is received in the evaporation zone from which steam escapes via the steam outlet orifice 30.

Figure 7:
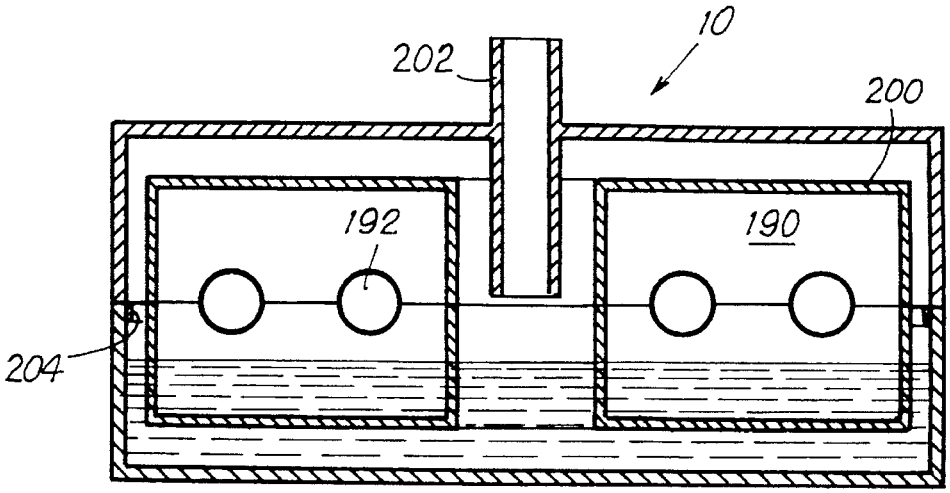
FIG. 7 shows a first embodiment of a cassette of circular section.

FIG. 7 shows another embodiment of the cassette 10 which is cylindrical in shape. Naturally, the other components of the generator must be adapted to this particular geometrical configuration which serves to deliver steam in all directions in three-dimensional space. The porous body 190 and the resistance element 192 are integrated in a ring 200 that is advantageously made of plastics material, that is concentric with the outer case of the cassette, and that leaves an empty cylinder in its center into which one end of a steam outlet tube 202 secured to the outer case penetrates down to about half depth. The volume of water injected by the pump and lying in the bottom of the cassette is designed to avoid water flowing out through the steam outlet tube when the cassette is turned upside-down. This volume (i.e. in practice the water level inside the case) can be monitored by means of a set of electrical contacts comprising, for example, the screening of the resistance element 192 and a metal strip 204 applied against the inside portion of the case 10. As in the preceding embodiment of the cassette, the case may be assembled from two separable portions in order to facilitate maintenance, i.e. to facilitate changing the heater element or the porous material.

Figure 8:
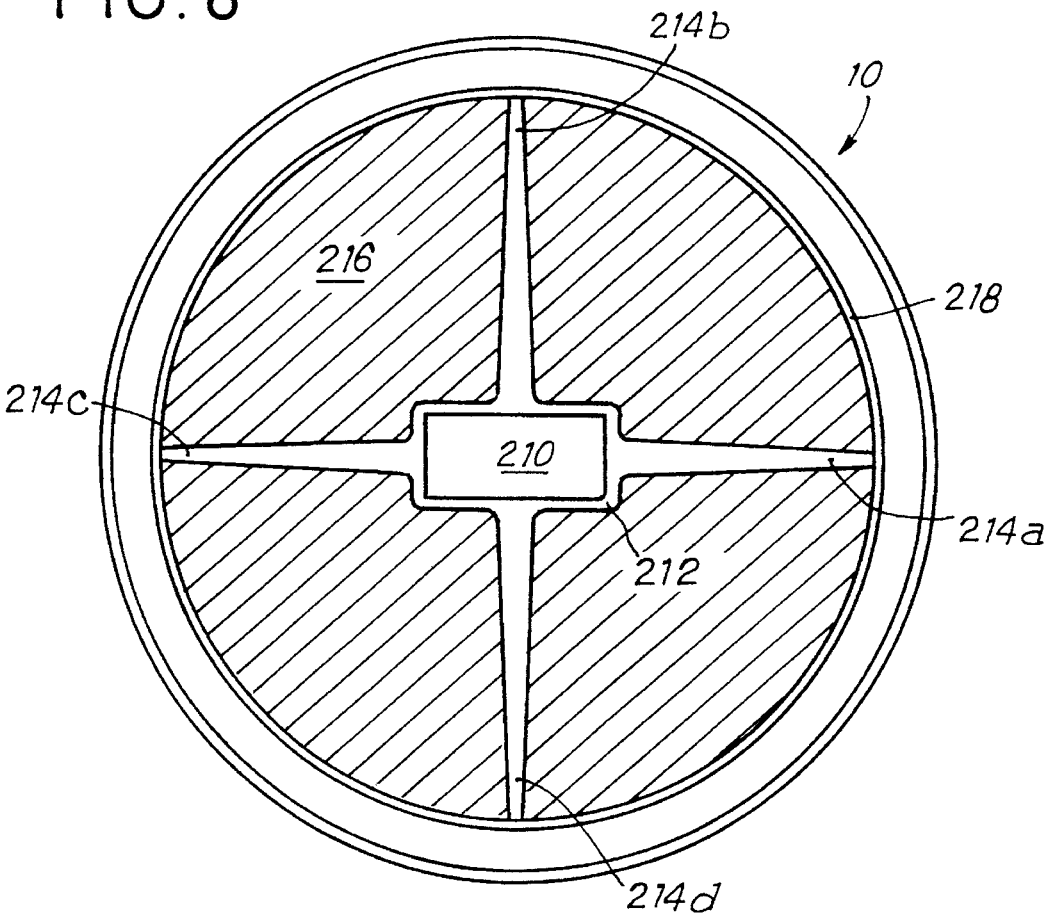
FIG. 8 shows a second embodiment of a cassette of circular section.

FIG. 8 shows a particular embodiment of the cassette 10 comprising a resistance element 210 which is preferably of the ceramic type and which is inserted in the center of a diffuser 212 (e.g. by crimping or as a force-fit). The diffuser is made of a heat-conducting material such as aluminum, for example, and is provided with at least three fins 214*a* to 214*d* projecting from opposite sides of its center. A porous body 216 is inserted under pressure (is compressed) between each fin and is held in place by a perforated circular case 218 that is advantageously constituted merely by a grid.

Figure 9:
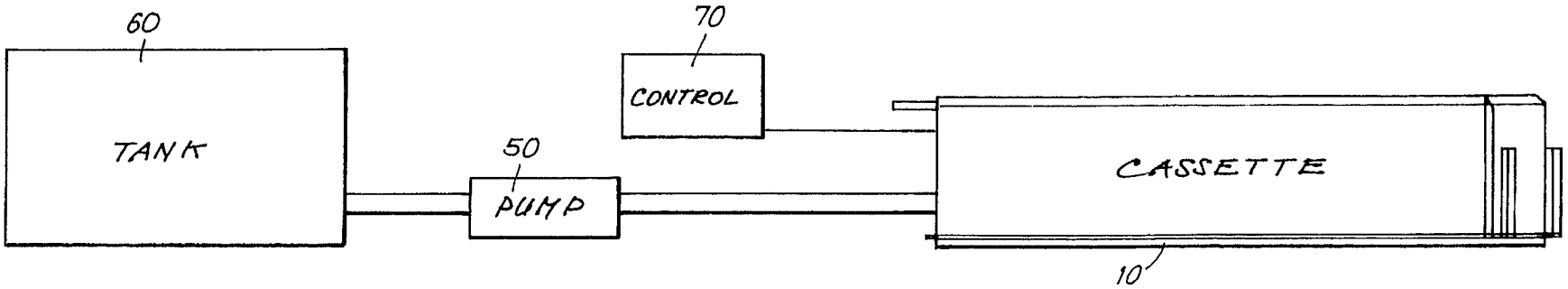
FIG. 9 is a diagram showing a method of descaling the steam cassette from an external pump-and-tank assembly.

FIG. 9 seeks in highly diagrammatic manner to illustrate a method enabling a cassette to be cleaned so that it can be reused. For this purpose, it is necessary to connect the water feed duct of the cassette to pumping means (e.g. the water feed pump 50) themselves connected to a water tank (e.g. the external tank 60), and to connect the heater elements to an external control device 70. The pump extracts water from the tank and injects it into the cassette where it is heated to a determined temperature lower than its evaporation temperature but greater than 60° C. so as to retain scale and non-soluble minerals. The water can subsequently be extracted via the steam outlet orifice 30.

I claim:

1. A steam generator including an orifice for feeding water to a porous material, a heater element passing through said porous material, and an outlet orifice for the steam created by heating said water, wherein the porous material and its heater element are contained in a case disposed in a removable cassette that is connected in operation to a fixed portion of the generator containing water feed means, means for controlling the heater elements, and means for taking off the steam, said cassette comprising an outer housing member that provides means to connect said case to said water feed means, to said means for controlling the heater elements and to said means for taking off the steam.

2. A steam generator according to claim 1, wherein the cassette is connected to the fixed portion of the generator by means of clips suitable for enabling rapid connection and disconnection.

3. A steam generator according to claim 1, wherein the water feed means include an external tank and a pump placed between the tank and the water feed orifice, and enabling water to be selectively injected into the generator.

4. A steam generator according to claim 3, wherein the water pumped from the tank is injected into the top portion of the cassette by means of a spray strip.

5. A steam generator according to claim 1, wherein the water feed means include manual filling means having a siphon for limiting the depth to which water can be filled in the cassette.

6. A steam generator according to claim 5, wherein the manual filling means further include means for interrupting heating and water feed, which means are controlled by rotation of a filler stopper placed at the inlet of said filler means.

7. A steam generator according to claim 1, further including steam regulator means at the outlet from the cassette.

8. A steam generator according to claim 1, further including visible or audible indicators for monitoring water level, planeness, and clogging by scale of the cassette.

9. A steam generator according to claim 8, wherein clogging by scale is monitored by a device for measuring the conductivity of the water prior to evaporation, which device is connected to the cassette.

10. A removable steam cassette designed to be implemented with a steam generator according to claim 1, including a water admission orifice distributing said water to an internal case containing a heater element for heating said water, a first porous material being compressed around the heater element, said case including orifices over its entire surface for evacuating the steam produced by the heater elements, the steam being expelled from the cassette via a steam outlet orifice.

11. A removable steam cassette according to claim 10, including shutter means for shutting the water admission orifice and activated when the pressure inside the cassette is less than a determined pressure.

12. A removable steam cassette according to claim 10, further including a second porous material that is separated from the first porous material surrounding the heater element by a wall extending between two opposite sides of the cassette and leaving an empty space for the passage of steam, the second porous material which constitutes a trap for scale being soaked by means of a spray strip directly with the water pumped from the tank.

13. A removable steam cassette according to claim 12, wherein the wall includes orifices providing communication between the evaporation zone that contains the first porous material and the water feed zone that contains the second porous material, thereby enabling the first porous material to be irrigated with partially descaled water that has passed through the second porous material.

14. A removable steam cassette according to claim 10, wherein the first porous material and the heater element are integrated in a ring that is advantageously made of plastics material, that is concentric with the outer case of the cassette and that has a free cylinder in its center into which a steam outlet tube secured to said circular outer case plunges to about half-depth.

15. A removable steam cassette according to claim 10, wherein the case is made up of two separable half-boxes having pierced top and bottom faces in order to make it easy to replace the porous material or the heater elements.

16. A removable steam cassette according to claim 10, wherein the heater element for the water circulating through the porous material is selected from the elements of the following group: a heater resistance element, a ceramic resistance, and electrodes.

17. A removable steam cassette according to claim 10, wherein the water heater element is constituted by a ceramic resistance inserted in the center of a diffuser element made of a heat-conducting material, the first porous material being engaged under pressure between at least three fins of said diffuser and being held in place by the perforated inner case.

18. A removable steam cassette according to claim 10, including high and low water level detection means detecting the levels for co-operating with means for monitoring said levels and present in the fixed portion of the generator.

19. A removable steam cassette according to claim 18, wherein, in order to determine the presence of a determined level of water in the case, said detection means further include a set of electrical contacts including both the screening of the heater element and a metal strip pressed against the internal portion of the cassette.

* * * * *